United States Patent [19]

Browning

[11] Patent Number: 4,778,349

[45] Date of Patent: Oct. 18, 1988

[54] MULTIPLE MACHINE DRIVE SHAFT AND COUPLING ADAPTER ASSEMBLY

[76] Inventor: Henry A. Browning, Rte. 1, Box 90, Quitman, Ga. 31643

[21] Appl. No.: 798,541

[22] Filed: Nov. 15, 1985

[51] Int. Cl.[4] ..... F04B 17/06

[52] U.S. Cl. ..... 417/231; 74/156; 248/295.1; 248/298; 403/299; 403/343; 417/238; 417/359

[58] Field of Search ..... 417/238, 231, 360, 361, 417/364, 319, 426, 359; 403/299, 343; 74/15.6; 248/295.1, 298.5

[56] References Cited

U.S. PATENT DOCUMENTS

| | | | |
|---|---|---|---|
| 893,756 | 7/1908 | Spencer | 417/359 X |
| 1,329,560 | 2/1920 | Thomas | 417/359 |
| 1,389,782 | 9/1921 | Perrin | 417/344 X |
| 1,453,416 | 5/1923 | Stanley | 417/399 |
| 1,597,659 | 8/1926 | Hoerr | 248/295.1 |
| 1,726,884 | 9/1929 | Brown | 248/295.1 |
| 1,750,170 | 3/1930 | Frisch | 417/238 |
| 2,059,175 | 10/1936 | Myracle | 403/299 X |
| 2,299,879 | 10/1942 | Court | 417/231 |
| 2,469,181 | 5/1949 | Slater | 74/15.6 |
| 2,775,204 | 12/1956 | Batten et al. . | |
| 2,804,016 | 8/1957 | Moore . | |
| 3,022,740 | 2/1962 | Wilfley et al. | 417/360 |
| 3,341,128 | 9/1967 | Nagin et al. . | |
| 3,567,123 | 6/1971 | Mitchell . | |
| 3,681,919 | 8/1972 | Forster | 417/238 X |
| 4,080,123 | 3/1978 | Melchinger . | |
| 4,103,852 | 8/1978 | Fisk | 248/316.8 X |
| 4,344,305 | 8/1982 | Holmes . | |
| 4,362,476 | 12/1982 | Kemmer et al. | 417/363 X |
| 4,363,603 | 12/1982 | Petersen . | |
| 4,430,047 | 2/1984 | Ilg . | |
| 4,437,814 | 3/1984 | Kalbac | 417/363 X |
| 4,606,921 | 8/1986 | Williams | 248/316.7 X |

FOREIGN PATENT DOCUMENTS

| | | | |
|---|---|---|---|
| 648252 | 12/1928 | France | 417/231 |
| 470964 | 8/1937 | United Kingdom | 417/231 |

*Primary Examiner*—Carlton R. Croyle
*Assistant Examiner*—Ted Olds
*Attorney, Agent, or Firm*—Dowell & Dowell

[57] ABSTRACT

A drive shaft and coupling adapter assembly for connecting multiple rotary machines to be driven in tandem in a predetermined direction by a single source of power having a rotating power take-off, each machine having a housing with aligned shaft bearings, and further including a common machine support disposed opposite the power take-off; a coupling adapter having a bore extending therethrough and one end of the bore having female screw threads therein and the other end of the bore being shaped to couple to the power take-off; and a drive shaft for each of said rotary machines, each shaft having a first end having male threads capable of engaging another shaft or the coupling adapter, and each shaft having a second end having female threads capable of engaging the male threads of another shaft, and each shaft being mounted in a machine and the shafts of the multiple machines being disposed in axial alignment and being screwed together to form a composite shaft and being screwed to said coupling adapter, and the machine support having multiple locations for supporting either the machine housings or a bearing block which carries the outer end of the composite shaft.

15 Claims, 2 Drawing Sheets

MULTIPLE MACHINE DRIVE SHAFT AND COUPLING ADAPTER ASSEMBLY

BACKGROUND AND PRIOR ART

This invention relates to a drive shaft and coupling adapter assembly for connecting multiple rotary machines mounted on a common support to be driven in tandem in a predetermined direction by a single source of rotary power also fixed to support.

There are a number of situations in which it becomes desirable to mount and drive multiple similar machines from a common power source. For instance, it is often very desirable in farm applications to drive multiple pumps in a spraying operation, particularly where different chemicals are being sprayed on a field, which chemicals can not be pre-mixed. It is common practice for a farmer to tow behind his tractor a trailer having a tank thereon connected by hoses to tractor-mounted pump and spray heads. Ordinarily the farmer will spray the field with one chemical, and then will have to change tanks and/or chemical mixture and spray the same field again on subsequent passes to apply the second chemical mixture. This is time and labor consuming. Sometimes there are more than two chemicals which require application. Time and effort and expense could be saved if the applications can be done simultaneously, using individual pumps each spraying a different mixture and all driven by the same tractor power take-off. However, after such a multiple spraying operation, pumps that would not be further used on a subsequent operation would have to be removed immediately since a pump can not be run dry. Quick installation and removal of pumps to achieve different configurations is therefore necessary to increase efficiency.

Pumping is not the only situation in which quick interchangeability of machines is highly desirable. There are also applications for rotary electrical machinery and other devices to be drive from a common source of rotary power. Moreover, there are many non-farming uses requiring the driving of multiple pumps to handle diverse fluids.

U.S. Pat. No. 3,567,123 to Mitchell shows several pumps driven by a common engine to pump different fluids for spraying, but showing a very complex drive system which would be highly expensive to construct, and non-flexible in use. U.S. Pat. Nos. 2,804,016 to Moore, 3,341,128 to Nagin, and 4,430,047 to Ilg, show far simpler constructions including two pumps driven by a common shaft, but the pumps are not easily separable and therefore the system is inflexible in use.

U.S. Pat. No. 2,775,204 to Batten et al is the closest patent to the present disclosure, showing two pumps rotated by a common hydraulic motor, but not simultaneously. Moreover, the shafts are not screwed together to form a single virtually rigid shaft which permits mounting advantages as discussed hereinbelow. U.S. Pat. No. 4,344,305 to Holmes shows an adapter for coupling between a threaded shaft and a splined shaft, but fails to show the present over-all inventive cooperation of parts to provide a unitary desirable result.

There are several other pump patents showing a shaft having threads at one end, i.e. U.S. Pat. Nos. 4,363,603 to Petersen and 4,080,123 to Melchinger. However, no disclosure is known at this time showing male threads at one end of a pump shaft and cooperative female threads at the other end whereby multiple rotary machines can be coupled together in tandem and driven by a single source of rotary power.

THE INVENTION

The invention provides a drive shaft and coupling adapter assembly for connecting multiple rotary machines such as pumps to be driven in tandem in a predetermined direction by a single source of power having a rotating power take-off, each machine having a housing with shaft receiving openings aligned with shaft receiving bearing. The machines are supported on a common support which is fixed to the support of the power source, and a coupling adapter couples the machine shafts to the power source, one end of the adapter having female screw threads therein. The rotating machines each have a drive shaft having a first end having male threads capable of cooperatively engaging the female threads of the coupling adapter and each shaft having a second end having female threads capable of cooperatively receiving the male threads of another drive shaft, the shafts of the multiple machines being disposed in axial alignment and screwed together and to said coupling adapter, and said threads being so directed as to be tightened when the power take-off is rotated in said predetermined direction, the multiple machines being mounted on said common support meanss with their shaft ends mutually screwed together and with the coupling adapter screwed into the first end of the machine shaft nearest the power take-off and coupled thereto, whereby to couple the machines in tandem for rotation therewith. The common support for the machines is adjustably mounted with respect to the power take-off and is structured to support different numbers of machines at different locations axially spaced in front of the power take-off so that the number of tandem driven machines can be quickly selected by screwing together or unscrewing machine shafts and changing the number of machines mounted on the support means.

OBJECTS AND ADVANTAGES OF THE INVENTION

It is a principal object of the invention to provide a threaded drive shaft and coupling adapter assembly for the common support and tandem drive of multiple machines connected in line to a single source of rotary power, wherein virtually the only limitation on the number of machines which may be so connected is determined by the power available at the source.

It is another principal object of the invention to provide such an assembly in which the common support and drive shaft means provide for the quick changing of the number of machines so supported and driven, permitting the quick selective addition and removal of machines in the tandem connection.

It is a major object of the invention to provide a versatile common support means which is easily attachable to a source of rotary power and which is adjustable for the purpose of bringing the shafts of the tandem connected machines into alignment with the power take-off at the source of power, and which supports the machines in such a way as to make the proper alignment of their shafts and bearings easy and certain in order to avoid wear on the bearings due to misalignment of the machines with the power take off during driving of the machines. The common support means imposes no inherent limitation on the number of machines that can be connected in tandem, so long as the source of power is sufficient to drive the machines.

It is another major object of the invention to provide in the threaded drive and coupling adapter mating male and female threads integrally formed on the ends of the drive shafts and the adapter, whereby the shafts of the multiple machines can be screwed together to form a composite shaft configuration which is rigid, sturdy and vibration free, and yet quickly and easily disassemblable to permit changing the number of machines in the tandem connection. Wrench flats are provided on the shafts to facilitate their assembly and disassembly. Each machine shaft has a male thread at one end and a corresponding female thread at the other end, and the coupling adapter has a female thread at one end, whereby the male end of each shaft can be connected either to the coupling adapter, or alternatively to the female end of the next machine located between it and the power take-off.

Another important object of the invention is to provide a drive assembly for rotation in a predetermined direction, wherein the threads on the shafts and the coupling attachment are disposed in a direction to tighten the threaded engagements when the machines are being drive by the power take-off. Specifically, the threaded engagements will employ left-hand threads when the power take-off rotates to the right, and right-hand threads when the power take-off rotates to the left.

A further object of the invention is to provide a support, drive and coupling adapter assembly which is especially useful for attaching multiple pumps to the power take-off of a tractor while supporting the housings of the pumps on a common support means fixed to the pull bar of the tractor, whereby the number of pumps so mounted and driven by the tractor take-off can be adjusted according to the number of different chemical mixtures to be pumped for spraying purposes as the assembly is drawn behind the tractor.

Other objects and advantages of the invention will become apparent during the following discussion of the drawings:

DESCRIPTION OF PREFERRED EMBODIMENT OF THE INVENTION

Figure 1:
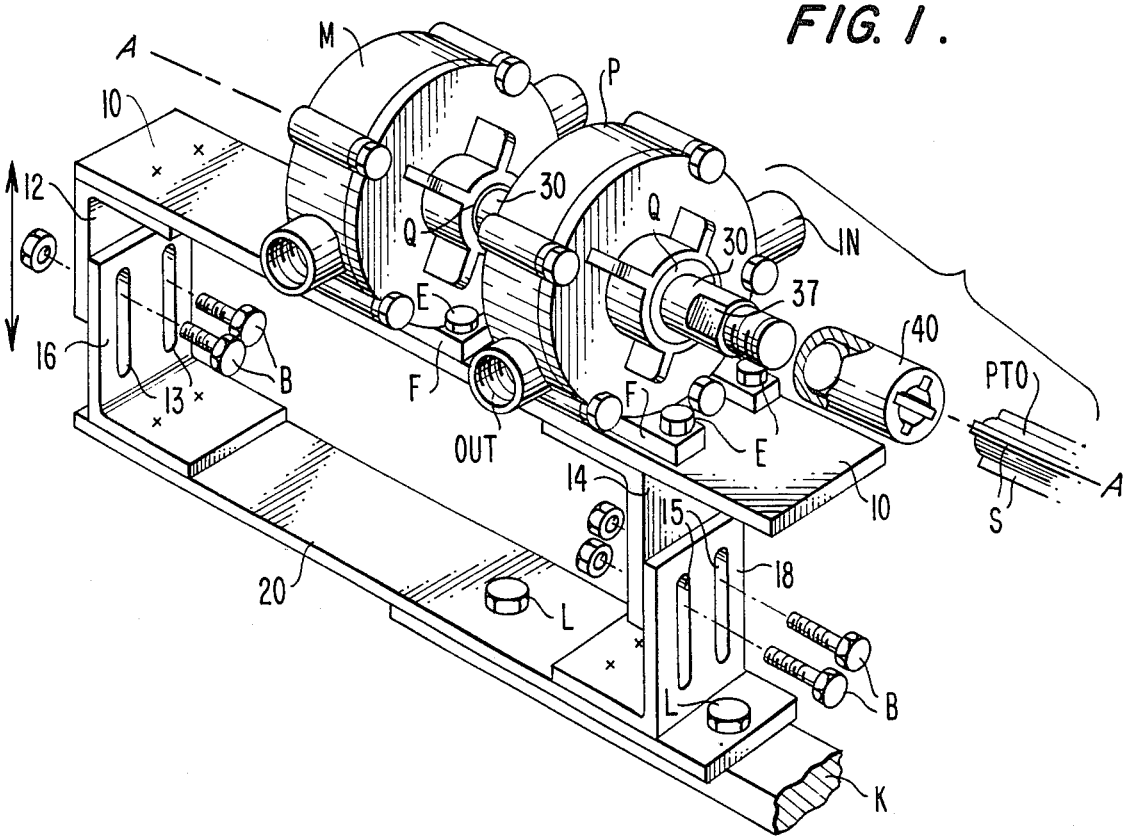
FIG. 1 is a perspective view of a drive shaft and coupling adapter assembly according to the present invention showing several machines coupled together and mounted on a common support.

Referring now to the drawings, FIG. 1 shows a perspective view of two rotary machines M and P, mounted on a common support which includes a mounting plate 10 which is supported on two brackets 12 and 14 which are welded to it. These brackets are in turn supported by two other brackets 16 and 18 which are welded to a bottom plate 20. The brackets have aligned slots therethrough such as the slots 13 and 15 which are visible in FIG. 1, and bolts B transfix the brackets through these aligned slots and secure the brackets together in adjacent positions to provide a desired spacing between the plates 10 and 20. The common support means thus provided has its bottom plate 20 bolted down to a fixed member which is rigidly positioned with respect to a source of rotary power. In this illustration the fixed member comprises the pull bar K of a tractor to which the bottom plate 20 is secured by bolts L, and the source of rotary power comprises the tractor's power take-off PTO which is a shaft having splines S thereon. In this illustrative embodiment, the machines M and P comprise pumps which are secured to the mounting plate 10 in the manner hereinafter described. The tractor parts such as the power take-off PTO and the pull bar K are shown merely for illustrative purposes and do no limit the use of this invention, which can be variously attached to other prime movers in various other machinery applications, within the scope of this invention.

Figure 2:
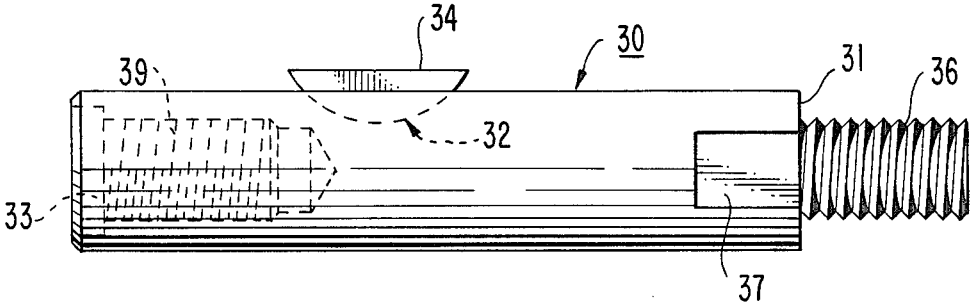
FIG. 2 is an elevation view of a drive shaft according to this invention.

The machines M and P, in this illustration comprising pumps, are standard purchased items which have been modified by replacing their original shafts with special drive shafts 30 made in accordance with this invention and illustrated in FIG. 2. Each drive shaft 30 comprises a cylindrical shaft having an outer diameter which is the same as the shaft supplied by the manufacturer of the purchased pumps M and P, and having means for mounting the pump impellers (not shown) thereon, such means taking the form in the present illustration of a keyway 32 and key 34, although any other conventional means for mounting the impellers can be substituted. Each drive shaft 30 has a first end having male threads 36 extending beyond a shoulder 31, and having a second end having female threads 39 extending into a bore 33. These male and female threads are the same pitch and diameter and are so directed as to tighten their mutual engagement when the shafts are rotated to turn the pumps in a predetermined direction. A pair of wrench flats 37 are included near the male end of the shaft so that they are accessibly located outside the housings of the pumps when the shafts are assembled therein.

Figure 3:
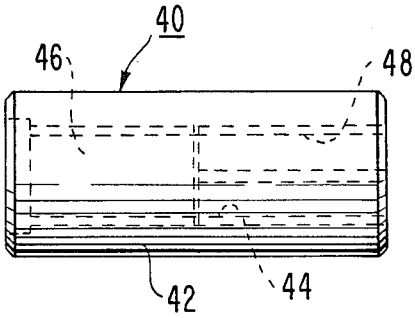
FIG. 3 is an elevation view of a coupling adapter according to this invention.

A coupling adapter 40, FIG. 3, for coupling the male end of one shaft 30 to the power take-off PTO comprises a cylindrical body 42 having a bore 44 extending therethrough. A first end of the bore 44 is threaded with female threads 46 which are designed to receive the male threads 36 of a shaft 30 and are similar to the threads 39 at the female end of a shaft. The second end of the bore 44 has female splines 48 therein as can best be seen in FIG. 1. If needed, a cotter pin or set screw can be added to the adapter to prevent separation thereof from the shafts which it is engaging, although in the tractor PTO organization of parts such a retaining device is unnecessary.

As shown in FIG. 1, the machines M and P, shown as pumps, are secured on the upper mounting plate 10 by passing bolts E through the plate 10 and the feet F of the machines, the shafts 30 of the two machines being screwed together and the forward shaft of the machine P being screwed into the coupling adapter 40 at its female threaded bore 46. The splined bore 48 of the coupling adapter 40 is slipped onto the power take-off PTO before the bolts E are inserted and tightened down. In practice it has been found sufficient to use bolts E only through the feet F of the rearmost machine M to hold the machines to the mounting plate 10.

If the bottoms of the feet F have been machined to precise spacings from the centers of the shafts 30, this method of mounting is satisfactory. However, if the feet F are merely rough-cast, then a more resilient method of mounting the machines M and P to the mounting plate 10 is desirable to avoid excessive wear of the bearings Q in the machines caused by misalignments thereof.

Figure 4:
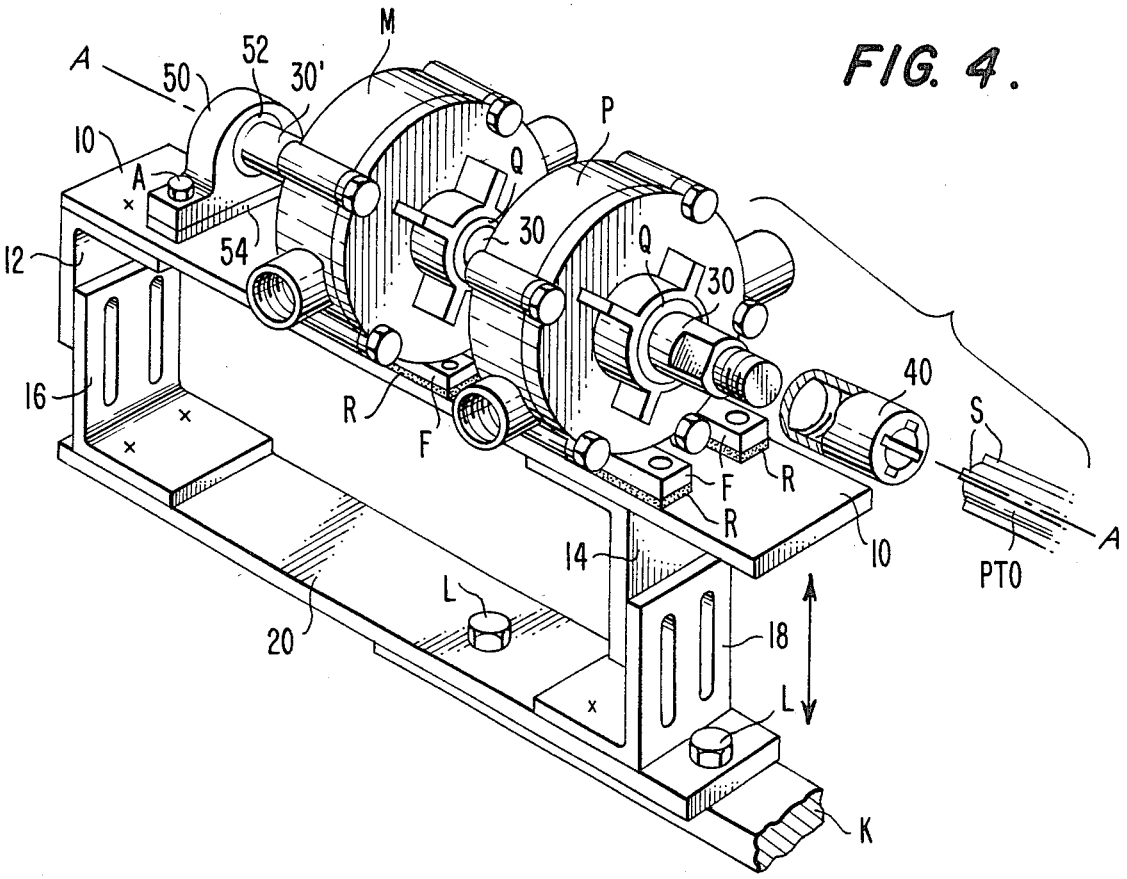
FIG. 4 is a perspective view similar to FIG. 1 but showing a modified way of mounting the machines on said common support.
Figure 5:
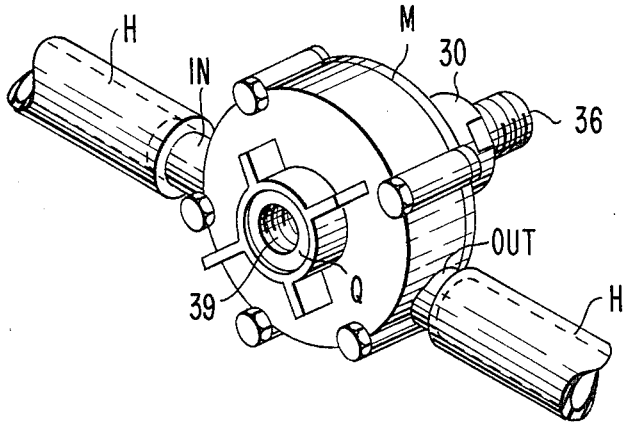
FIG. 5 is a rear perspective view of a machine fitted with a shaft according to this invention.

FIG. 4 shows such a mounting having bearing-protective resiliency which allows the bodies of the machines M and P to "float" somewhat while restraining them from rotation. As stated above, when the shafts 30 of the multiple machines M, P, . . . are screwed together, they form a virtually rigid composite shaft attached at one end to the power take-off PTO by the coupling adapter 40. The embodiment of FIG. 4 provides at the other end of the composite shaft 30—30, an auxiliary shaft 30' which has male threads at one end which are similar to those of the shafts 30, the auxiliary shaft 30' being supported in a pillow bearing block 50 which is rigidly bolted to the mounting plate 10 by bolts A. The bearing block 50 includes a bearing 52 receiving and supporting the auxiliary shaft 30' whose male end screws into the female threads 39 of the rearmost machine M, which threads 39 are visible in FIG. 5. The pillow block 50 may be spaced accurately above the mounting plate 10 by a shim 54. In this embodiment, the feet F of the machines M and P merely rest upon resilient pads R without being bolted to anything, whereby the housings of the machines M and P are free to adjust to the best positions of alignment to reduce wear on their bearings, the composite shaft 30, 30 and 30' being rigidly supported by the pillow block 50 and by the power take-off PTO. In the case where the machines M and P comprise pumps, their respective inputs IN and outputs OUT are normally connected to relatively stiff hoses H, FIG. 5, which further resist any tendency of the pump housings to rotate.

The pillow block bolts A, FIG. 4, and the foot mounting bolts E, FIG. 1, are passed through holes (not shown) in the mounting plate 10 and are held down by nuts and lock washers in a manner well known per se. The holes in the plate 10 can be slotted to facilitate accurate positioning of the machines M and P in directions axially of their shafts, and to facilitate quick changing of the total number of machines connected and driven in tandem at any particular time. The common support means is adjustable for the purpose of bringing the shafts of the tandem connected machines into alignment with the power take-off and supports the machines in such a way as to make the proper alignment of their shafts and bearings easy and certain along the drive axis shown at A—A as shown at FIG. 1 of the drawings in order to avoid wear on the bearings due to misalignment of the machines with the power take-off. The illustration of two machines thus connected and driven in FIGS. 1 and 4 is not intended to limit the number of machines which can be mounted on the common support means and driven by the power take-off PTO in a practical installation.

This invention is not to be limited to the exact forms illustrated in the drawings, for obviously changes may be made within the scope of the following claims.

I claim:

1. A drive shaft and coupling adapter assembly for connecting multiple rotary machines to be driven in tandem in a predetermined direction by a single source of power having a rotating power take-off, each rotary machine having a housing with shaft receiving openings in the housing aligned with shaft receiving bearing means, the assembly comprising:

(a) common support means having a surface portion upon which said rotary machines are disposed adjacent said power take-off;

(b) a coupling adapter having an annular body with a bore extending therethrough, one end of the bore having female screw threads therein and the other end of the bore being shaped to cooperatively engage said power take-off;

(c) a drive shaft for each of said rotary machines, each drive shaft being mounted within the shaft receiving opening of each of said rotary machines and having first and second ends, said first ends extending outwardly of said rotary machines, said first ends having male threads capable of cooperatively engaging the female threads of said coupling adapter, said second ends having female threads capable of cooperatively receiving said male threads of an adjacent one of said drive shafts, said drive shafts of the multiple rotary machines being disposed in axial alignment and screwed together and to said coupling adapter, and said male and female threads being so directed as to be tightened when the power take-off is rotated in the predetermined direction;

(d) the multiple rotary machines being supported on said common support means with their drive shaft ends mutually screwed together, said common support means including adjustable bracket means for adjustably aligning said surface portion of said support means with respect to the power take-off so that said drive shafts are in axial alignment with the power take-off and with said one end of said coupling adapter screwed on said first end of one of said machine drive shafts nearest the power take-off and having said other end thereof secured to the power take-off, whereby to couple the multiple rotary machines in tandem for rotation therewith.

2. The drive shaft and coupling adapter assembly of claim 1, wherein the rotary machines comprise pumps, and the power take-off is the power take-off of a tractor; and wherein the tractor has a pull bar extending parallel to the power take-off, said common support means being adjustably mounted on the pull bar.

3. The drive shaft and coupling adapter assembly as claimed in claim 1, wherein the common support means is structured to support different numbers of machines at different locations so that the number of tandem driven machines can be selectively changed by screwing together or unscrewing said drive shafts and changing the number of rotary machines supported on said support means.

4. The drive shaft and coupling adapter assembly as claimed in claim 3, further including a bearing block; means for selectively mounting the bearing block on said support means spaced from the power take-off; and an auxiliary shaft supported in the bearing block and having male threads at one end thereof, said male threads of said auxiliary shaft being screwed into the female threads in said second end of one of said drive shafts furthest from the power take-off.

5. The drive shaft and coupling adapter assembly as claimed in claim 3, further including resilient means on said support means and disposed to contact the rotary machine housings and prevent them from rotating with respect to said support means when said drive shafts are being driven.

6. The drive shaft and coupling adapter assembly as claimed in claim 1, wherein each of said drive shafts has wrench flats thereon disposed adjacent said first end thereof, said wrench flats being accessibly located and spaced outside the rotary machine housing when said drive shaft is mounted in a rotary machine.

7. A multiple pump assembly to be driven by a power take-off means of a common source of power and which power take-off means rotates about an axis comprising, at least first and second pump means having housings with driven openings extending therethrough and bearing means supported within each housing adjacent said openings, at least first and second drive shafts mounted within said openings in each of said first and second pump means so as to be rotatable relative to said housings, each of said drive shafts having first and sescond ends, each of said first ends of each of said drive shafts extending outwardly so as to be in spaced relationship to said housings, said first end of one of said first and second drive shafts being selectively and cooperatively engagable with said second end of the other of said first and second drive shafts, a coupler means having first and second ends, said first end of said coupler means having an opening therein for selectively and cooperatively engaging the source of power so as to be axially aligned therewith, said first end of said other of said drive shafts being selectively and cooperatively engagable with said second end of said coupler means, mounting means connected to the source of power, said mounting means having a support section extended outwardly from the power take-off of said source of power, each of said pump means being supported in tandem relationship by said mounting means, said mounting means being adjustable relative to the axis of said power take-off means, and securing means for retaining said mounting means in a selectively adjustable position thereby said drive shafts are alignable with said axis of the power take-off means and with said coupler means and said pump means are concurrently connected to be driven by the common source of power.

8. The multiple pump assembly of claim 7 including resilient means mounted between each of said pump means and said support section of said mounting means.

9. The multiple pump assembly of claim 8 in which said second ends of said drive shafts and coupler means include similar female screw threads disposed interiorly thereof and said first end of said drive shafts and said auxiliary shaft include similar male screw threads which are cooperatively engagable with said female screw threads.

10. The multiple pump assembly of claim 7 in which said second ends of said drive shafts and coupler means include similar female threads and said first end of said drive shafts include male screw threads which are engageable with said female screw threads.

11. The multiple pump assembly of claim 10 in which said first end of said coupler means includes a female splined socket section.

12. The multiple pump assembly of claim 7 in which each of said drive shafts include wrench flats, said wrench flats being oriented adjacent said first ends of said drive shafts and being in spaced relationship exteriorly of said housings.

13. A multiple pump assembly to be driven by the power take-off of a common source of power comprising, at least first and second pump means having housings with drive openings extending therethrough and bearing means supported within each housing adjacent said openings, at least first and second drive shafts mounted within said openings in each of said first and second pump means so as to be rotatable relative to said housings, each of said drive shafts having first and second pump means so as to be rotatable relative to said housings, each of said drive shafts having first and second ends, said first end of one of said first and second drive shafts being selectively and cooperatively engagable with said second end of the other of said first and second drive shafts, a coupler means having first and second ends, said first end of said coupler means having an opening therein for selectively and cooperatively engaging the source of power so as to be axially aligned therewith, said first end of said other of said drive shafts being selectively and cooperatively engagable with said second end of said coupler means, mounting means connected to the source of power, said mounting means having a support section extended outwardly from the power take-off of said source of power, each of said pump means being supported in tandem relationship by said mounting means, said mounting means including vertical movable adjusting means for permitting said drive shafts to be axially aligned with said coupler means and the power take-off whereby said pump means and second drive shafts being selectively and cooperatively engagable with said second end of the other of said first and second drive shafts, a coupler means having first and second ends, said first end of said coupler means having an opening therein for selectively and cooperatively engaging the source of power so as to be axially aligned therewith, said first end of said other of said drive shafts being selectively and cooperatively engagable with said second end of said coupler means, mounting means connected to the source of power, said mounting means having a support section extended outwardly from the power take-off of said source of power, each of said pump means being supported in tandem relationship by said mounting means, said mounting means including adjusting means for permitting said drive shafts to be axially aligned with said coupler means and the power take-off, a bearing block means mounted to said mounting means of said support means and having an auxiliary shaft supported therein, said auxiliary shaft having a remote end extending toward the power take-off, said remote end of said auxiliary shaft being selectively and cooperatively engagable with said second end of one of said drive shafts.

14. The multiple pump assembly of claim 13 including resilient means disposed between said pump means and said support section of said mounting means.

15. The multiple pump assembly of claim 9 in which said adjusting means include vertically oriented and opposing members, each of said members being slideably vertically adjustable with respect to one another, and locking means for selectively securing said members in adjusted position.

* * * * *